US005794559A

United States Patent [19]

Graham

[11] Patent Number: 5,794,559

[45] Date of Patent: Aug. 18, 1998

[54] FUEL TANK

[76] Inventor: Bill Graham, 11669 Malden St., Cypress, Calif. 90630

[21] Appl. No.: 790,074

[22] Filed: Jan. 28, 1997

[51] Int. Cl.[6] ..... B63B 8/00

[52] U.S. Cl. ..... 114/343; 220/563

[58] Field of Search ..... 440/88; 114/343, 114/345, 363; 220/563

[56] References Cited

U.S. PATENT DOCUMENTS

| | | | |
|---|---|---|---|
| 4,942,838 | 7/1990 | Boyer et al. | 114/345 |
| 5,154,134 | 10/1992 | Goldsmith | 114/345 |
| 5,423,702 | 6/1995 | Butler | 440/88 |

*Primary Examiner*—Jesus D. Sotelo

*Attorney, Agent, or Firm*—Knobbe, Martens, Olson & Bear LLP

[57] ABSTRACT

A space-efficient fuel tank for use in a small watercraft powered by an outboard motor is disclosed. The fuel tank is securely but removably mounted to the interior of the watercraft in the previously unusable space immediately underneath and adjacent the outboard motor in its tilted-up condition. In the preferred embodiment, the shell of the fuel tank is generally "U"-shaped in order to optimize the storage space efficiency of the fuel tank when it is positioned in the space underneath the outboard motor. The fuel tank is securely mounted to the watercraft by brackets, which adjustably attach to the top of the fuel tank and extend out and over the back portion of the watercraft near the outboard motor to secure the tank in position immediately underneath and adjacent to the outboard motor.

18 Claims, 4 Drawing Sheets

FUEL TANK

FIELD OF THE INVENTION

The present invention relates to fuel tanks used to store fuel for combustion by the engine of a motor powering a watercraft. More particularly, the present invention relates to a fuel tank for use in a small engine-powered watercraft having an outboard motor, yielding improved space efficiency and fuel delivery efficiency.

BACKGROUND OF THE INVENTION

Present fuel distribution systems for small watercraft powered by outboard motors having an internal combustion engine typically consist of a fuel tank and a fuel supply line extending from the fuel tank to the engine. In small watercraft, where a less powerful motor is needed to provide adequate propulsion, a small outboard motor is conventionally mounted at the stern of the watercraft. The motor is pivotally mounted for tilting about a horizontally disposed axis between a normal running condition to a tilted-up condition. The fuel tank, which is normally a portable container, stores a supply of fuel such as conventional gasoline. This fuel is delivered to and burned by the engine, driving a water propulsion device such as a propeller and propelling the watercraft through a body of water. The fuel supply line connects the fuel tank to a fuel supply input on the outboard motor. The fuel supply line is typically made of rubber or flexible plastic.

In its tilted-up condition, the powerhead portion of the outboard motor extends into the interior of the watercraft, and thus sufficient space near the outboard motor inside the watercraft must remain unoccupied to accommodate the outboard motor in its tilted-up condition. Because of this space requirement, fuel tanks of a conventional shape and size for a small watercraft do not fit in the restricted space inside the watercraft underneath the outboard motor while still accommodating the outboard motor in its tilted-up condition, and thus the space underneath the outboard motor is typically left unused or wasted.

When a supply of fuel contained in the fuel tank has been spent, the fuel supply line may be disconnected from the outboard motor once the engine is turned off. The fuel tank may then be removed from the watercraft, refilled with fuel, and reconnected to the outboard motor via the fuel supply line for further use.

The fuel tank conventionally used in the foregoing system can hold several gallons of fuel, typically two (2) to six (6) gallons, and the fuel tank comes in a conventional cubicle or block shape. The shell of the fuel tank is typically made of a hard plastic or plastic resin, which may be molded into shape by a conventional plastics manufacturing process.

During normal operation, the fuel tank is typically placed on the floor of the watercraft, as near to the outboard motor as possible, in order to keep the fuel supply line out of the way of persons or objects present in the watercraft. The larger the fuel capacity of the tank, the more fuel may be continuously provided to the outboard motor for a longer running time until it becomes necessary to refill the tank or change to a reserve fuel tank. As stated above, however, conventionally shaped fuel tanks having a large enough capacity to hold an adequate supply of fuel typically cannot be placed immediately underneath the outboard motor, which is the closest and most desirable position for the fuel tank, because of the space needed inside the watercraft to accommodate the outboard motor in its tilted-up condition. Instead, the fuel tank is typically placed to the side of the outboard motor, if there exists adequate space to accommodate the tank without interfering with the movement of the outboard motor, or alternatively somewhere toward the center of the watercraft. Thus, the fuel tank typically cannot be placed in its most desirable position inside the watercraft—immediately underneath the outboard motor in its tilted-up condition—and this space therefore typically goes unused and is wasted.

In addition, the fuel tank in the above-described system is typically not secured to the watercraft. Instead, the portable fuel tank is conventionally cubicle or block-shaped, and has no means of attachment to the watercraft. Thus, the fuel tank may move or slide around inside the watercraft when the watercraft turns or stops or when acted upon with sufficient force. When the fuel tank is allowed to move inside the watercraft, attendant problems may result, such as fuel spillage, damage to the fuel tank or other objects inside the watercraft, and injury to persons. The fuel supply line may also stretch, break, and cause injuries to nearby persons or property if the fuel tank moves far enough away from the outboard motor to cause the fuel supply line to disengage from the outboard motor or the fuel tank, or both.

Thus, there remains a need for a fuel tank of adequate capacity that can be placed immediately adjacent and underneath the outboard motor of a watercraft, occupying previously unusable space, and that can be rigidly secured to the watercraft, preventing the fuel tank from sliding, spilling fuel, or otherwise moving around the interior of the watercraft.

SUMMARY OF THE INVENTION

It is an object of this invention to provide a fuel tank for storing and delivering fuel to the engine of a motor-powered watercraft which overcomes the above-described problems associated with conventional fuel tanks.

First, the fuel tank of the present invention preferably includes mounting means in the form of a pair of brackets attached to the fuel tank outer shell for mounting and securing the fuel tank to the watercraft in a position underneath and adjacent the outboard motor.

Second, the fuel tank preferably has an outer shell that is U-shaped, so that it will optimally fit underneath the outboard motor in its tilted-up condition and efficiently use space that has previously gone unused.

Further, the fuel tank preferably includes a first top end surface having a fuel input opening with a fuel cap removably sealing the fuel input opening and comprising a fuel gauge showing the amount of fuel remaining in the fuel tank, and a second top end surface having a fuel outlet opening comprising a conduit extending to a fuel outlet opening in the shell, this conduit in turn is preferably connected to a fuel delivery line extending to the engine. In addition, the fuel tank may include a top middle surface disposed substantially between the first top end surface and the second top end surface, and a carrying strap attached to the top middle surface.

Preferably, the fuel tank has upwardly extending end portions, and a bulging lower portion such that the volume of the container remains large even though it has a middle section which is depressed to accommodate the outboard motor in its raised position.

Also in the preferred embodiment, the fuel tank preferably includes a plurality of rear contact pads attached to the shell providing contact points between the fuel tank and the motor-powered watercraft.

DETAILED DESCRIPTION OF THE PREFERRED EMBODIMENTS

Figure 1:
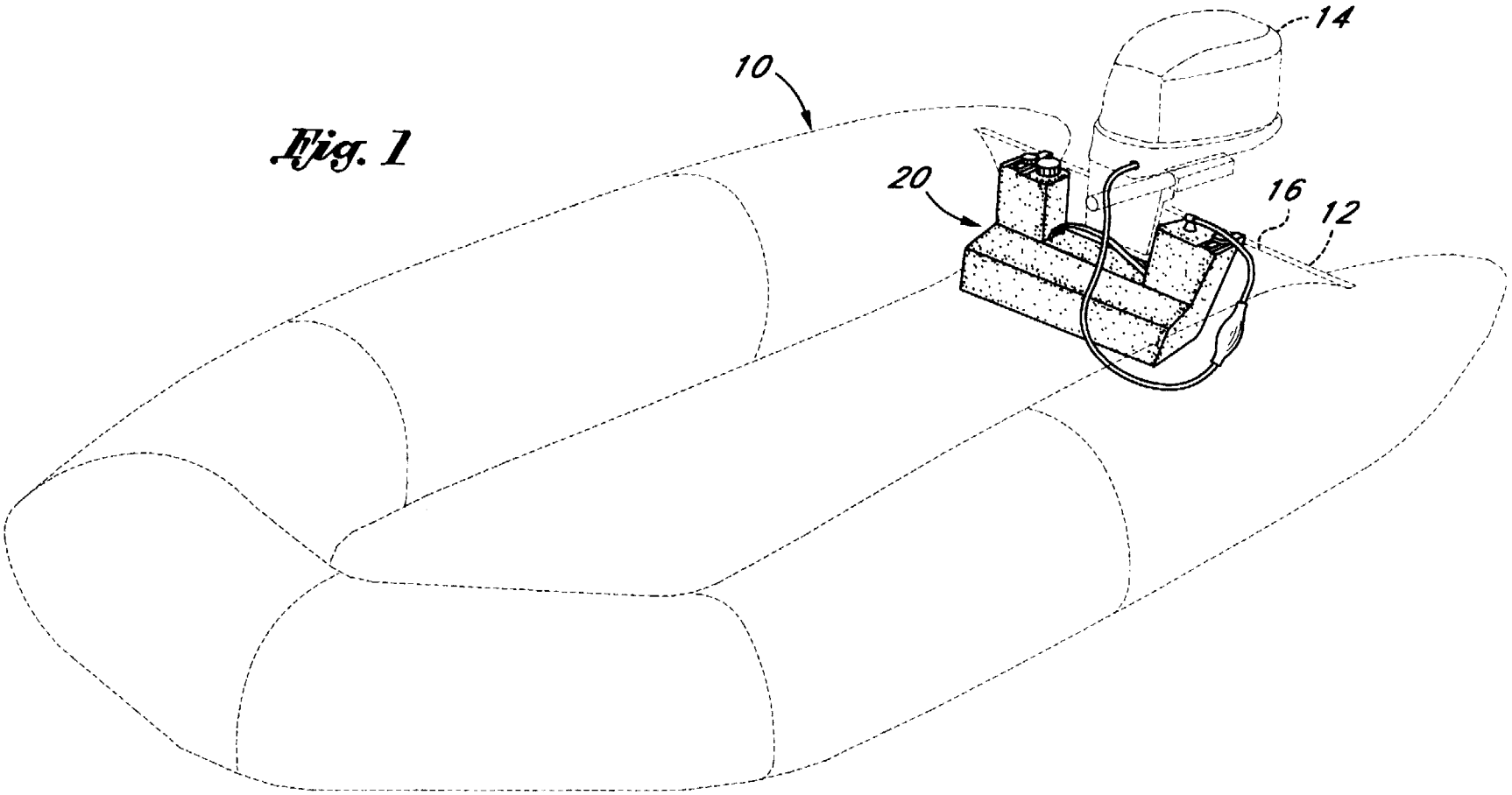
FIG. 1 is a perspective view of a watercraft having an outboard motor and a fuel tank in accordance with the present invention, the watercraft and outboard motor appearing in phantom lines.
Figure 2:
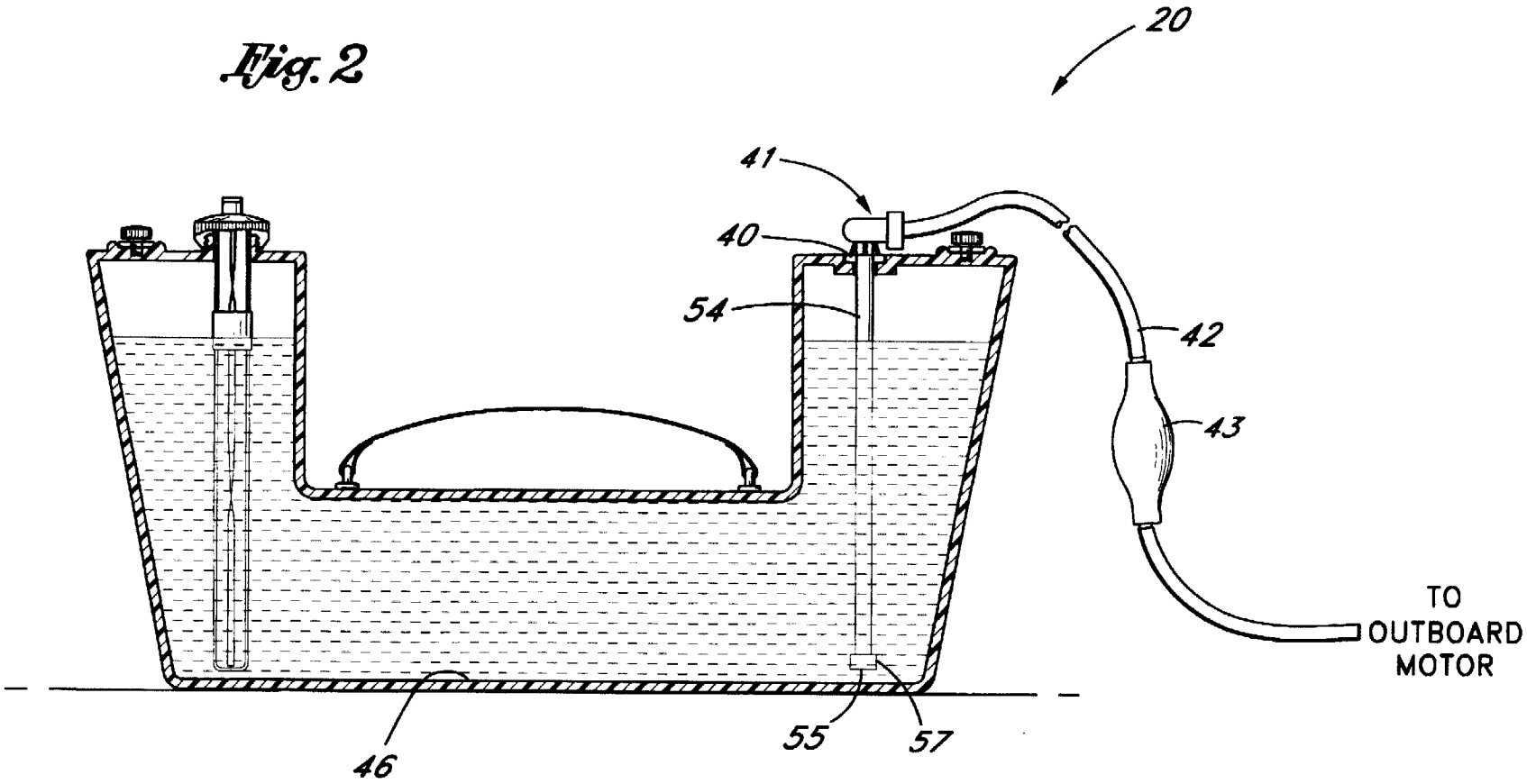
FIG. 2 is a front cut-away view of the fuel tank of the present invention, showing the interior region of the fuel tank.
Figure 3:
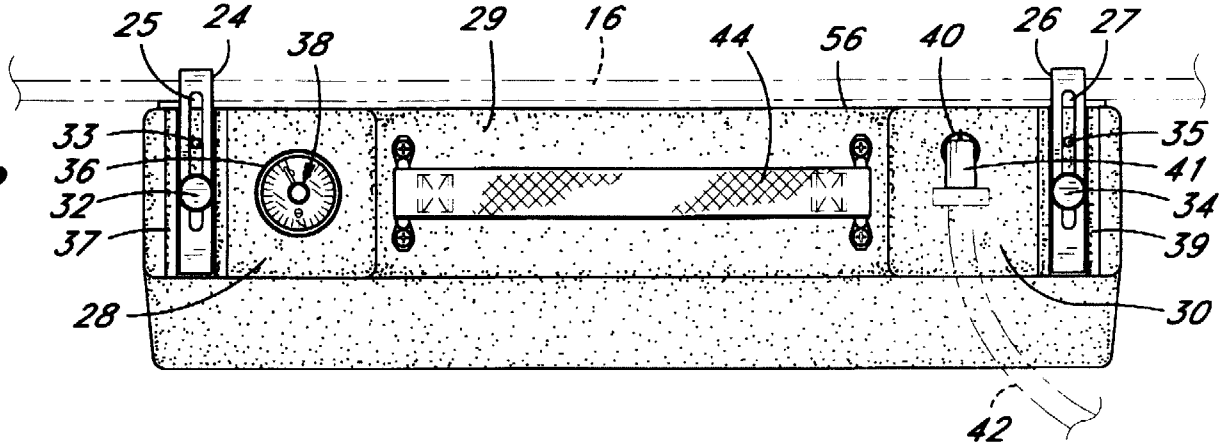
FIG. 3 is a top plan view of the fuel tank of the present invention.

FIGS. 1–7 illustrate a fuel tank 20 in accordance with the present invention. In general, the fuel tank 20 comprises a container for containing and storing liquid fuel, such as gasoline, used to power the engine of an outboard motor of a watercraft 10. The fuel tank 20 comprises a shell or wall defining an internal storage area. A fuel delivery apparatus is provided for delivering fuel from the tank 20 to an engine. Referring to FIG. 2, this apparatus preferably includes an internal fuel supply conduit 54 attached to a fuel outlet opening 40 formed in the shell, and a fuel outlet conduit 41 extending from the fuel outlet opening 40 and attached to a fuel supply line 42. A fuel tank cap 38 (FIG. 5) is attachable to a fuel input opening 36 formed in the shell, and a pair of brackets 24,26 are adjustably attached to the fuel tank shell by mounting screws for use in mounting and securing the fuel tank 20 to the watercraft 10 as shown in FIG. 3. In addition, a plurality of contact pads 58,59,60,61 positioned on the rear outside surface of the fuel tank 20 may contact the rear wall portion of the watercraft 10, and a carrying strap 44 assembly is preferably connected to the fuel tank 20 for use in lifting and carrying the fuel tank 20.

The fuel tank 20 of the present invention is especially useful for a number of reasons. First, the shell is generally U-shaped, having a recessed center section, thus allowing the fuel tank to be placed in a position immediately adjacent and underneath the outboard motor of the watercraft 10, thereby making optimal use of the area inside the watercraft adjacent and underneath the outboard motor. Second, the fuel tank 20 is securely attachable to the watercraft 10, thereby reducing the risk of fuel spillage and injury to property or persons both inside and outside the watercraft.

Referring now to FIG. 1, the fuel tank 20 in accordance with the present invention will be described in more detail. As illustrated therein, the fuel tank 20 of the present invention is used to store fuel for burning by an engine 14 of an outboard motor powered watercraft 10.

The watercraft 10 typically has a rear wall or "transom" portion 12 at the stern of the watercraft, at which an outboard motor 14 is mounted. The rear wall portion 12 has an upper edge 16 to which the outboard motor 14 is securely mounted. The fuel tank 20 also mounts on the upper edge 16, and is thereby secured in place to the rear wall portion 12 of the watercraft 10. During normal operation, therefore, the fuel tank 20 resides immediately below and adjacent to the outboard motor 14, inside the watercraft 10.

Figure 5:
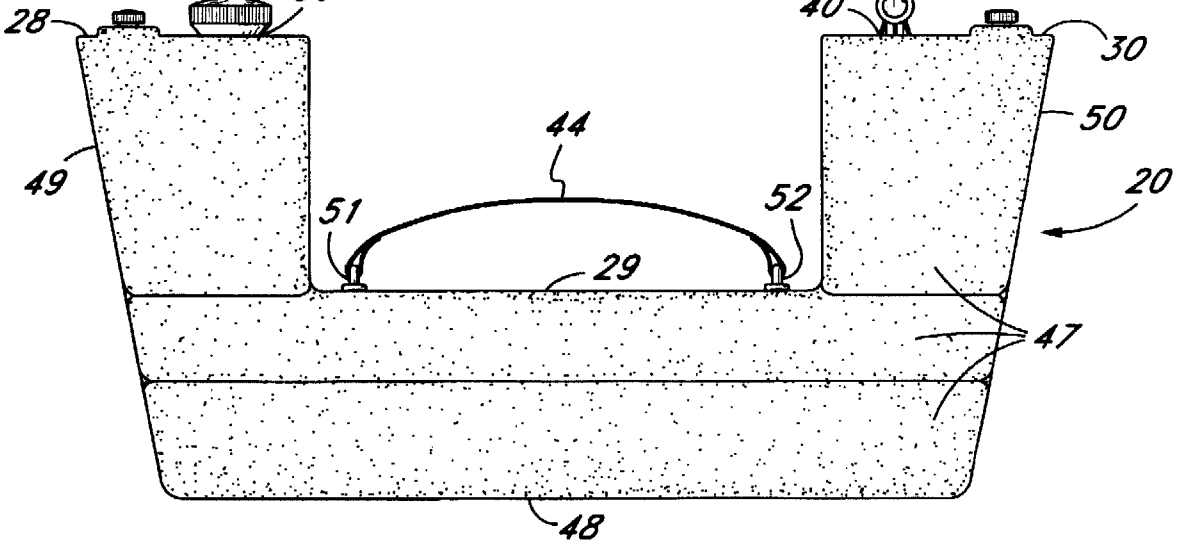
FIG. 5 is a front elevational view of the fuel tank of the present invention.

As illustrated in FIG. 5, the fuel tank 20 is generally "U"-shaped when viewed from the front or rear. The fuel tank 20 preferably has a top defined by two upwardly rising end sections 28,30 and a depressed middle section 29 therebetween, and has a bottom 48. In addition, the fuel tank 20 has a first outer side 49 and an opposing second outer side 50. Lastly, the fuel tank 20 has a front side 47 and a rear side 56 (see also FIG. 4). The configuration of the fuel tank 20 will be described in more detail below.

FIG. 2 illustrates how fuel stored and contained in the interior of the fuel tank 20 is drawn out of the fuel tank 20 through an internal fuel conduit 54, located inside the tank shell, and is then drawn through a fuel outlet opening 40, through a fuel outlet conduit 41, and into a fuel supply line 42 extending to the fuel inlet of the outboard motor 14. The fuel supply line 42 is typically made of rubber or flexible plastic material, and preferably contains a squeezable "primer" bulb 43 somewhere in the line which may be used to start the flow of fuel through the line, if necessary. Alternatively, the fuel outlet opening 40 may be located on another surface of the fuel tank 20.

Fuel contained in the fuel tank 20 first enters the internal fuel conduit 54 through an internal fuel conduit input opening 55, which resides at or near the end of the internal fuel conduit 54 opposite the fuel outlet opening 40. An inlet filter 57, which may be any type of suitable filtering device, such as a screen, may be placed at the internal fuel conduit input opening 55. The inlet filter 57 prevents debris or other particles that may reside in the fuel inside the fuel tank 20 from potentially blocking the internal fuel conduit input opening 55 and therefore the fuel supply to the outboard motor 14.

The internal fuel conduit input opening 55 is positioned near, but preferably not at, the fuel tank inside bottom surface 46. Preferably, the internal fuel conduit input opening 55 resides about one-quarter of an inch above the inside bottom surface 46. The internal fuel conduit 54 should be securely fastened at one end to the fuel outlet opening 40. In the preferred embodiment, the internal fuel conduit 54 is made of a stiff plastic material, such as polyethylene, so that it remains rigid and straight inside the tank, extending down from the fuel outlet opening 40 to about a quarter-inch above the inside bottom surface 46 of the fuel tank. The fuel outlet conduit 41 is also preferably made of a hard plastic material, and serves to direct the primarily vertical flow of fuel coming out of the internal fuel conduit 54 through the fuel outlet opening 40 into the fuel supply line 42, where the flow of fuel will be, at least initially, primarily horizontal rather than vertical.

FIG. 3 is a top plan view of the fuel tank 20 of the present invention. As illustrated therein, a pair of mounting brackets 24 and 26 are attached to the top of each end section 28 and 30 of the fuel tank 20 by mounting screws 32 and 34. The mounting brackets 24 and 26 of the present invention are preferably made of a strong metal, such as steel, but can also be made of another suitable material, as will be readily understood by those of skill in the art. Each mounting bracket preferably includes slots 25 and 27 to receive a respective mounting screw. Each mounting screw 32 and 34, preferably used in conjunction with an appropriately-sized, conventional washer, is tightened down through the slot in the corresponding mounting bracket 24 and 26 and into one of a plurality of screw holes 33 and 35. The screw holes are located within the top end surfaces 28 and 30 of the fuel tank, without penetrating into the interior of the fuel tank shell.

The mounting brackets 24 and 26, when mounted, are positioned in corresponding receiving portions 37 and 39 of the top of the end sections 28 and 30, which receiving portions may be defined by a raised border or a depression, shaped to accommodate a mounting bracket and molded into the shell of the fuel tank 20. The screw holes 33 and 35 used should be chosen so that the mounting brackets 24 and 26, when tightened, extend the proper distance from the rear outside surface 56 of the fuel tank to securely and tightly mount the fuel tank in its desired position underneath the fuel tank. The mounting screws 32 and 34 of the present invention should securely fasten the mounting brackets 24 and 26 to the top of the end sections 28 and 30 of the fuel tank 20. However, the mounting screws 32 and 34 and mounting brackets 24 and 26 of the present invention should be sufficiently adjustable to permit the fuel tank to mount securely to various watercraft having an upper edge 16 of the rear wall portion 12 of varying thicknesses. For example, several screw holes may be provided for each screw, as will be understood by those of skill in the art and as shown in FIG. 3. Additionally, the mounting screws 32 and 34 of the present invention need not be of any particular type, as long as they are adjustable. It is preferable that a threaded screw that may be hand-tightened be used together with a washer to secure the mounting bracket in place, as will be readily understood by those of skill in the art. In use, the cap 38 is removed and fuel may be placed in the tank through opening 36.

Different means of mounting the fuel tank of the present invention, besides the above-described mounting bracket and screw arrangement, may be used and may perhaps perform equally well in satisfying the objects of the present invention. For example, the fuel tank could be mounted in position with associated mounting posts which could be secured in place through holes in the rear wall portion 12 of the watercraft 10. Or, for example, a mounting stand or trough could be constructed to hold the fuel tank securely in position adjacent to and underneath the outboard motor 14. These and other methods and ways of mounting the fuel tank in its desired position could be implemented, and will be readily be understood by those of ordinary skill in the art.

The top defined by one end section 28 has a fuel input opening 36 which accommodates a fuel cap 38. The cap 38 is detachable, but is also securely fastenable to the fuel input opening 36 to prevent fuel leakage, and includes a gauge which displays the fuel level remaining in the fuel tank. The fuel input opening 36 is threaded to accommodate the cap 38, which is also threaded, thus allowing it to be easily screwed on and subsequently removed. The fuel input opening 36 and accompanying fuel cap 38 of the present invention should be of standard size and design, as will be readily understood by those of skill in the art. In use, the cap 38 is removed and fuel may be placed in the tank 20 through opening 36.

The other end section 30 of the fuel tank 20 has a fuel outlet opening 40 and a fuel outlet conduit 41 therethrough, to which the fuel supply line 42 attaches. The fuel outlet conduit 41 should preferably be a molded, hard plastic piece, and it preferably remains attached to the fuel tank 20 at the fuel outlet opening 40, even when the fuel tank 20 is moved or refilled. Fuel passes out of the fuel tank 20 through the fuel outlet opening 40 and fuel outlet conduit 41, and then passes into the fuel supply line 42, to be delivered to the fuel inlet of the outboard motor 14.

Figure 4:
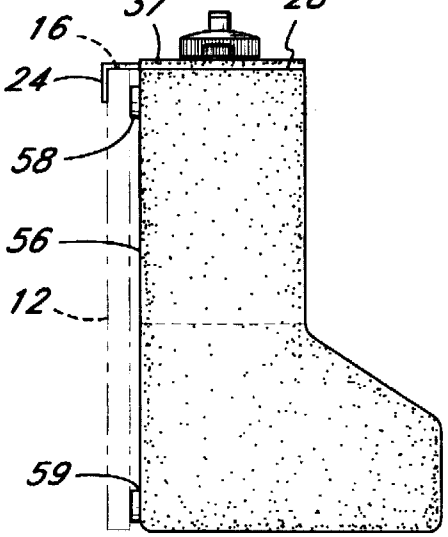
FIG. 4 is a left side elevational view of the fuel tank of the present invention.

Referring to FIG. 4, a left side elevational view of the present invention is shown. One of the two mounting brackets 24 is shown secured to one end section 28 of the fuel tank 20, and it extends outwardly from the rear of the fuel tank 20 and then downwardly (i.e., being generally "L"-shaped), in order to leave sufficient space to engage the upper edge 16 of the rear wall portion 12 of the watercraft 10. The mounting bracket 24 extends downwardly to adequately grip the upper edge 16. Also shown in FIG. 4 are two rear contact pads 58 and 59, which cushion the contact that would otherwise be made directly between the rear outside surface 56 of the fuel tank 20 and the rear wall portion 12 of the watercraft 10 during normal operation. The rear contact pads 58 and 59 are preferably formed of a hard rubber material, although other suitable materials can also be used which will provide a cushioning effect. The contact pads are secured to the rear outside surface 56 by screws, which penetrate but do not extend through the shell of the fuel tank 20. The rear contact pads 58 and 59 shown in FIG. 4, along with two additional rear contact pads (not shown in FIG. 4), should preferably be placed near the four outward corners of the rear outside surface 56 of the fuel tank 20, so that the cushioning function of the rear contact pads is evenly distributed over the entire rear outside surface 56 of the fuel tank 20. This aspect of the preferred embodiment is more clearly shown in FIG. 7, which shows the two additional contact pads 60 and 61.

Referring again to FIG. 5, while the rear surface 56 of the fuel tank is flat, the front outside surface 47 is not flat. Instead, the front outside surface 47 extends outwardly near the bottom portion of the fuel tank 20 below the top middle surface 29 (see also FIG. 4), in order to accommodate a larger volume of fuel inside the tank near the bottom of the tank, and in order to provide more surface area at the bottom surface 48 of the fuel tank, thereby improving the stability of the fuel tank when it is set down. Preferably, the shortest distance between the front surface 47 and the rear surface 56 near the bottom surface 48 is at least one and a half times the shortest distance between the front surface 47 and the rear surface 56 near the top (such as at 28,30). However, this ratio may change for other configurations of the fuel tank 20 of the present invention.

As also shown in FIG. 5, in the preferred embodiment the two side surfaces 49 and 50 of the fuel tank 20 slope slightly inwardly toward the bottom surface 48 of the tank. As will be readily understood in the art, the sides may be formed with another slope, or without any slope (i.e., vertical), for reasons of aesthetics or space efficiency in a particular application of the present invention.

Finally, as best seen in FIG. 5, the carrying strap 44 of the present invention is fastened to the top of the middle section 29 of the fuel tank 20 by small loops 51 and 52 secured to the top of the middle section 29. The loops 51 and 52 are preferably made of a strong metal and fastened to the tank shell with metal screws. Other means of attaching the carrying strap 44 to the fuel tank 20, such as fastening the carrying strap 44 to a different surface or surfaces of the tank, or providing a handle instead of a carrying strap, will be readily understood by those of skill in the art. Because the carrying strap 44 is used for lifting and carrying the fuel tank, which is heavy when full of fuel, the carrying strap 44 should be made of nylon or other appropriately strong material.

Figure 7:
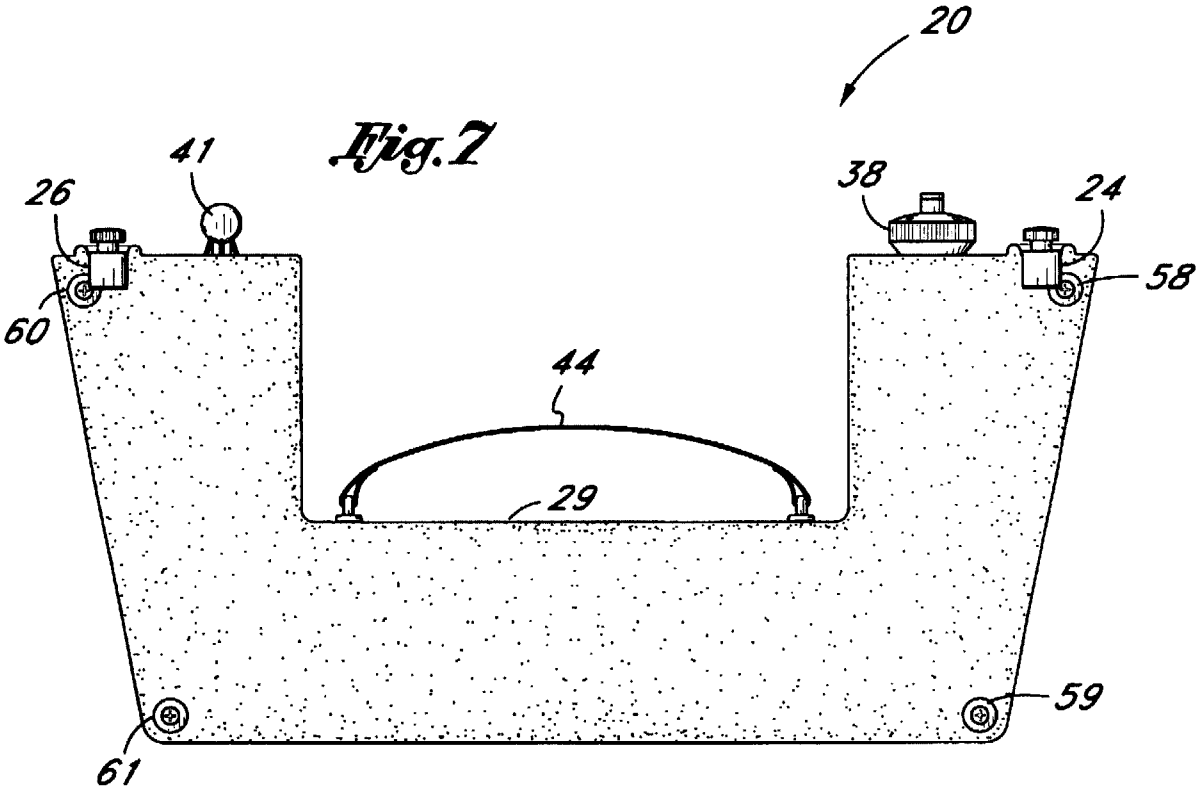
FIG. 7 is a rear elevational view of the fuel tank of the present invention.
Figure 6:
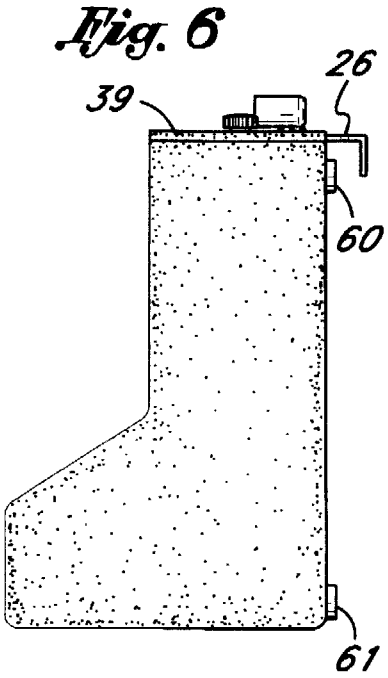
FIG. 6 is a right side elevational view of the fuel tank of the present invention.

FIGS. 6 and 7 provide further illustration of the aspects of the present invention and preferred embodiment that have been previously discussed.

In the preferred embodiment, the fuel tank 20 has the following dimensions: distance from bottom 48 to the top of each end section 28,30, 11 inches; distance from bottom 48 to the top at the middle section 29, 5 inches; length of bottom 48, 19 inches; distance across top from end section to end section, 23 inches; distance from front to rear at top, 4 inches; distance from front to rear at bottom, 6.5 inches; and distance along middle section 29 between end section 28,30, 12 inches.

The storage capacity of the fuel tank 20 of the present invention as described is approximately 3.1 gallons of fuel. It is understood that the fuel tank 20 may be appropriately sized for use with differing size watercraft, and in such situations may have a differing capacity.

While the fuel tank 20 has been described for use in storing primarily gasoline, it is understood that the fuel tank may be used to store a variety of other liquid fuels, such as kerosene, oil and gasoline mixtures, or the like. In addition, the fuel tank is preferably constructed from a material suitable for holding liquid fuels such as plastic. Other such materials are readily known by those of skill in the art.

Although the foregoing invention has been described in terms of certain preferred embodiments, other embodiments will become apparent to those of ordinary skill in the art in view of the disclosure herein. Accordingly, the present invention is not intended to be limited by the recitation of preferred embodiments, but is intended to be defined solely by reference to the appended claims.

What is claimed is:

1. A fuel tank for storing fuel to be delivered to the engine of a motor which powers a watercraft, said fuel tank comprising:

a container having an inner storage area defined by a wall, said container having a "U"-shape when viewed in at least one direction, said container including a first end, a second end and a middle portion therebetween, said ends and middle portion defining a top of said container, said top at said first and second ends positioned above said top at the middle portion a first aperture positioned in said top at said first end portion through which fuel may be delivered to said inner storage area, a second aperture positioned in said top at said second end portion, and a fuel cap for positioning in said first aperture, said fuel cap including a fuel gauge for indicating the level of fuel in said tank.

2. The fuel tank in accordance with claim 1, further including a fuel delivery pipe extending through said second aperture into said inner storage area.

3. The fuel tank in accordance with claim 1, further including means for mounting said fuel tank to a watercraft.

4. The fuel tank in accordance with claim 3, wherein said means comprises at least one bracket.

5. The fuel tank in accordance with claim 4, wherein said bracket is generally "L"-shaped, and further including means for releasably securing said bracket to said container.

6. The fuel tank in accordance with claim 1, further including a strap connected to said container for use in carrying said tank.

7. In combination, a watercraft having a stern defined in at least one area by a wall portion, an outboard motor mounted to said watercraft at said stern, said outboard motor having an engine; and a fuel tank for storing and supplying fuel to said engine, said fuel tank comprising a container with an inner fuel storage area, said container being "U"-shaped when viewed in at least one direction, means for mounting said fuel tank to said wall portion of said watercraft adjacent said outboard motor, and further including means for delivering fuel from said fuel tank to said engine, wherein when said outboard motor is moved to a tilted-up position, said motor extends into a trough of said "U"-shaped container.

8. The combination in accordance with claim 7, wherein said means for delivering comprises a delivery tube having a first end positioned within said storage area and a second end extending therefrom, and a delivery line extending from said second end of said tube to said engine.

9. The combination in accordance with claim 7, further including means positioned on said container for spacing said container wall from said watercraft.

10. The combination in accordance with claim 9, wherein said means comprises at least one pad.

11. The combination in accordance with claim 7, wherein said means for mounting comprises at least one bracket having a first portion engaging said container and a second portion for engaging said wall of said watercraft.

12. The combination in accordance with claim 7, wherein said container has a first elevated end and a second elevated end and a middle section therebetween which is lower than said ends, and wherein an aperture is positioned in a top surface of both said first and second ends.

13. The combination in accordance with claim 12, wherein a fuel cap is positioned in said first aperture and a fuel delivery tube extends through said second aperture.

14. A fuel tank for storing fuel to be delivered to the engine of a motor which powers a watercraft, said fuel tank comprising:

a container having an inner storage area defined by a wall, said container having a "U"-shape when viewed in at least one direction, said container having at least one opening for use in delivering fuel to said inner storage area and from which fuel may be drawn from said inner storage area; and means for mounting said container to a watercraft, said means comprising at least one generally "L"-shaped bracket and means for securing said bracket to said container.

15. The fuel tank in accordance with claims 14, wherein said "U"-shape of said container is defined by a first end, a second end and a middle section between said ends and recessed below said ends.

16. A fuel tank for storing fuel to be delivered to the engine of a motor which powers a watercraft, said fuel tank comprising:

a container having an inner storage area, said container having a "U"-shape when viewed in at least one direction, said container having at least one opening for use in delivering fuel to said inner storage area and from which fuel may be drawn from said inner storage area; and a strap connected to said container for use in carrying said tank.

17. A fuel tank in accordance with claim 16, including means for mounting said container to a watercraft.

18. A fuel tank for storing fuel to be delivered to the engine of a motor which powers a watercraft, said fuel tank comprising:

a container having an inner storage area, said container having a "U"-shape when viewed in at least one direction, said container having a top, a bottom, a front side, a rear side, a first end and a second end, and wherein said top has a first portion, a second portion and a third portion, said first and second portions elevated above said third portion positioned therebetween, the distance between the front and the rear sides near the bottom of said tank being at least one and a half times the distance between the front and the rear sides near the top of said tank, said container having at least one opening for use in delivering fuel to said inner storage area and from which fuel may be drawn from said inner storage area.

* * * * *